US009633382B2

(12) United States Patent
Kim

(10) Patent No.: US 9,633,382 B2
(45) Date of Patent: Apr. 25, 2017

(54) MANAGEMENT APPARATUS AND BILLING METHOD THEREOF

(75) Inventor: Su-dong Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 13/064,991

(22) Filed: Apr. 29, 2011

(65) Prior Publication Data

US 2011/0295729 A1 Dec. 1, 2011

(30) Foreign Application Priority Data

May 25, 2010 (KR) ..... 10-2010-0048592

(51) Int. Cl.
*G07F 19/00* (2006.01)
*G03G 21/02* (2006.01)
*G06Q 30/04* (2012.01)

(52) U.S. Cl.
CPC ..... *G06Q 30/04* (2013.01)

(58) Field of Classification Search
CPC ..... G03G 21/04
USPC ..... 705/34
See application file for complete search history.

(56) References Cited

U.S. PATENT DOCUMENTS 3,911,254 A * 10/1975 Leibrecht ..... G06F 7/62 377/13
5,146,344 A * 9/1992 Bennett ..... G03G 15/50 358/296
5,383,129 A * 1/1995 Farrell ..... G03G 21/02 377/13
6,275,667 B1 * 8/2001 Miyazaki ..... G03G 21/02 358/474
6,674,545 B1 * 1/2004 Atsumi ..... G03G 15/50 358/1.14
7,194,433 B1 * 3/2007 Hyakutake ..... G06Q 10/087 705/34
7,280,971 B1 * 10/2007 Wimberly ..... G06Q 20/102 705/34
7,962,050 B2 * 6/2011 Shustef ..... G03G 15/55 399/79
2001/0037270 A1 * 11/2001 Melo ..... G06Q 30/04 705/34

(Continued)

FOREIGN PATENT DOCUMENTS

EP 1677244 A1 * 7/2006
JP 2001-034446 2/2001

(Continued)

OTHER PUBLICATIONS

European Search Report dated Sep. 6, 2011 issued in corresponding European Patent Application No. 11165141.0.

(Continued)

*Primary Examiner* — Ashford S Hayles
(74) *Attorney, Agent, or Firm* — Staas & Halsey LLP

(57) ABSTRACT

A management apparatus and a billing method which calculates a billing charge by using a cumulative output amount for a target billing period. In the management apparatus and billing method a billing charge is calculated by using a cumulative output amount for a target billing period, a cumulative output amount quota having the cumulative output amount for the target billing period, and a quota unit price corresponding to the cumulative output amount quota of at least one image forming apparatus.

17 Claims, 8 Drawing Sheets

(56) References Cited

U.S. PATENT DOCUMENTS

| | | | | |
|---|---|---|---|---|
| 2003/0151768 | A1* | 8/2003 | Iida | G03G 21/02 358/1.15 |
| 2007/0097161 | A1* | 5/2007 | Ejiri | B41J 2/17546 347/5 |
| 2007/0103716 | A1* | 5/2007 | Shiraiwa | G03G 21/02 358/1.14 |
| 2008/0107440 | A1* | 5/2008 | Tsuzuki | G03G 21/02 399/79 |
| 2011/0022505 | A1* | 1/2011 | Kino | G06Q 30/04 705/34 |
| 2011/0175955 | A1 | 7/2011 | Ejiri et al. | |
| 2011/0176161 | A1* | 7/2011 | Matsumoto | G03G 21/02 358/1.14 |
| 2013/0314461 | A1 | 11/2013 | Ejiri et al. | |

FOREIGN PATENT DOCUMENTS

| | | | | |
|---|---|---|---|---|
| JP | 2002-149020 | | 5/2002 | |
| JP | EP 1677244 | A1 * | 7/2006 | G06Q 30/04 |
| JP | 2009-128729 | | 6/2009 | |
| KR | 10-2009-0117671 | | 12/2009 | |

OTHER PUBLICATIONS

European Office Action dated Aug. 7, 2013 from European Patent Application No. 11165141.0.

Korean Office Action dated Feb. 16, 2016 from Korean Patent Application No. 10-2010-0048592, 14 pages.

European Oral Proceedings dated Nov. 23, 2015 from European Patent Application No. 11165141.0, 8 pages.

European Office Action dated Jul. 11, 2016 from European Patent Application No. 11165141.0, 27 pages.

Korean Office Action dated Aug. 22, 2016 from Korean Patent Application No. 10-2010-0048592, 5 pages.

* cited by examiner

| FIG. 2A | FIG. 2B |
|---|---|

FIG. 5

| 510 MODEL NAME | 520 CUMULATIVE OUTPUT AMOUNT QUOTA (NUMBER OF PAGES) | 530 | 540 COLOR BASIC CHARGE | 550 COLOR QUOTA UNIT PRICE | 560 MONO BASIC CHARGE | 570 MONO QUOTA UNIT PRICE | 580 RECORDING MEDIUM |
|---|---|---|---|---|---|---|---|
| ML-4000N | 0 ~ 2000 | QUOTA +/- | $ 0.00 | $ 0.00 | $ 150 | $ 0.05 | A4 |
| | 2001 ~ 5000 | | | $ 0.00 | | $ 0.03 | |
| | 5001 ~ 10000 | | | $ 0.00 | | $ 0.02 | |
| SCX-2000FN | 0 ~ 5000 | QUOTA +/- | $ 0.00 | $ 0.00 | $ 100 | $ 0.05 | A3,A4 |
| | 5001 ~ 10000 | | | $ 0.00 | | $ 0.04 | |
| | 10001 ~ 30000 | | | $ 0.00 | | $ 0.02 | |
| | 30001 ~ 70000 | | | $ 0.00 | | $ 0.01 | |
| CLX-3000N | 0 ~ 3000 | QUOTA +/- | $ 200.00 | $ 0.07 | $ 150 | $ 0.05 | A4 |
| | 3001 ~ 5000 | | | $ 0.05 | | $ 0.04 | |
| | 5001 ~ 10000 | | | $ 0.02 | | $ 0.02 | |

FIG. 6A

* MODEL NAME : ML-4000N
* CUMULATIVE OUTPUT AMOUNT QUOTA #1:0~2000
* CUMULATIVE OUTPUT AMOUNT QUOTA #2:2001~5000
* CUMULATIVE OUTPUT AMOUNT QUOTA #3:5001~10000
* CUMULATIVE OUTPUT AMOUNT QUOTA UNIT PRICE #1:$0.05
* CUMULATIVE OUTPUT AMOUNT QUOTA UNIT PRICE #2:$0.03
* CUMULATIVE OUTPUT AMOUNT QUOTA UNIT PRICE #3:$0.02,
* BASIC CHARGE : $150
* OUTPUT COLOR : Mono
* RECORDING MEDIUM : A4

FIG. 6B

| | BILLING PERIOD #1 | BILLING PERIOD #2 | BILLING PERIOD #3 | TOTAL |
|---|---|---|---|---|
| OUTPUT AMOUNT | 500 | 1200 | 3000 | 4700 |
| CUMULATIVE OUTPUT AMOUNT | 500 | 1700 | 4700 | 4700 |
| CUMULATIVE OUTPUT AMOUNT QUOTA UNIT PRICE #1 | $ 0.05 | $ 0.05 | $ 0.05 | $ 0.05 |
| CUMULATIVE OUTPUT AMOUNT QUOTA UNIT PRICE #2 | $ 0.03 | $ 0.03 | $ 0.03 | $ 0.03 |
| CUMULATIVE OUTPUT AMOUNT QUOTA UNIT PRICE #3 | $ 0.02 | $ 0.02 | $ 0.02 | $ 0.0 |
| BASIC CHARGE | $150 | $150 | $150 | $450 |
| VARIABLE COST | $25 | $60 | $96 | $181 |
| BILLING CHARGE | $175 | $210 | $246 | $631 |

MANAGEMENT APPARATUS AND BILLING METHOD THEREOF

CROSS-REFERENCE TO RELATED APPLICATIONS

This application claims priority from Korean Patent Application No. 10-2010-0048592, filed on May 25, 2010 in the Korean Intellectual Property Office, the disclosure of which is incorporated herein by reference.

BACKGROUND

1. Field

Apparatuses and methods consistent with the exemplary embodiments relate to a management apparatus and a billing method thereof which is connected to at least one image forming apparatus.

2. Description of the Related Art

An image forming apparatus may include a photocopier, a printer, a facsimile, and a scanner which output image data or a multi-function peripheral (MFP) which performs at least two of copy, print, scan, fax sending/receiving, e-mail sending and file transmitting functions.

An output amount of the image forming apparatus is stored in a storage unit of the image forming apparatus, and the stored output amount is transmitted to a management server connected to the image forming apparatus at every preset period through a wired/wireless network. The management server manages the output amount to calculate a billing charge corresponding to the output amount of the image forming apparatus.

For example, in the business to business (B2B) market, a supplier of a managed print service (MPS) solution (e.g., an image forming apparatus manufacturer) and a customer (e.g., a user of an image forming apparatus) enter into an agreement to determine at least one image forming apparatus subject to billing, a billing period, a unit price of a mono print per page and a unit price of a color print per page and to calculate a billing charge.

The billing charge is calculated on the basis of the output amount of the at least one image forming apparatus and a unit price per page with respect to the billing period determined according to the billing agreement. The calculated billing charge is billed to the customer of the image forming apparatus.

SUMMARY

Accordingly, one or more exemplary embodiments provide a management apparatus and a billing method thereof which calculates a billing charge by using a cumulative output amount, a plurality of cumulative output amount quotas and quota unit prices corresponding to the cumulative output amount quotas of at least one image forming apparatus for a billing period.

The foregoing and/or other aspects may be achieved by providing a billing method of a management apparatus which is connected to at least one image forming apparatus, the billing method including: setting a billing profile corresponding to the at least one image forming apparatus through a user interface (UI) screen provided by a display unit of the management apparatus; requesting and receiving output information from the at least one image forming apparatus; calculating a cumulative output amount for a target billing period comprising an output amount for the target billing period and a cumulative output amount for a previous billing period by using the output information; calculating a billing charge for the target billing period corresponding to the at least one image forming apparatus by using the cumulative output amount for the target billing period and the set billing profile, the previous billing period preceding the target billing period; and displaying the calculated billing charge on the display unit of the management apparatus, the billing profile including a plurality of cumulative output amount quotas and quota unit prices corresponding to the plurality of cumulative output amount quotas.

The billing profile may include at least one of a customer name, a model name of an image forming apparatus, a type of billing jobs, recording medium information, an output information request interval and a billing period.

The output information may include at least one of a device ID, a model name, and counter information.

The calculating the billing charge for the target billing period may include selecting at least one cumulative output amount quota comprising the cumulative output amount for the target billing period among the plurality of cumulative output amount quotas; and calculating a billing charge by using a quota unit price corresponding to the at least one selected cumulative output amount quota.

The calculating the billing charge for the target billing period may include calculating the billing charge for the target billing period by applying a same quota unit price to the entire output amount for the target billing period or applying a plurality of different quota unit prices to the output amount for the target billing period.

The billing charge may further include a basic charge.

The billing method may further include providing the billing charge to an external device through a communication interface of the management apparatus.

Different image forming apparatuses with the same model name may include different billing profiles.

The billing method may further include initializing information on an output amount for at least one billing period.

The billing profile may be changeable with respect to at least one image forming apparatus.

The billing method may further include storing the calculated cumulative output amount in a storage unit of the management apparatus, and calculating a billing charge for a next billing period by using the stored cumulative output amount and an output amount for the next billing period.

The foregoing and/or other aspects may be achieved by providing a billing method of a management apparatus which is connected to at least one image forming apparatus, the billing method including: setting a billing profile corresponding to at least one image forming apparatus through a UI screen provided by a display unit of the management apparatus; requesting and receiving output information from at least one image forming apparatus; calculating an output amount for a target billing period and a cumulative output amount for a previous billing period by using the output information, the previous billing period preceding the target billing period; calculating a billing charge for the output amount for the target billing period corresponding to the at least one image forming apparatus by using the cumulative output amount for the previous billing period and the set billing profile; and displaying the calculated billing charge on the display unit of the management apparatus, the billing profile including a plurality of cumulative output amount quotas and a quota unit price corresponding to the plurality of cumulative output amount quotas.

The foregoing and/or other aspects may be achieved by providing a management apparatus which is connected to at least one image forming apparatus, the management apparatus including: a communication interface which is connected to the at least one image forming apparatus, and receives output information from the at least one image forming apparatus; a storage unit which stores therein a billing profile and the output information; a billing unit which calculates a cumulative output amount by using the output information, and calculates a billing charge for a target billing period corresponding to at least one image forming apparatus by using the cumulative output amount and the billing profile; and a controller which requests the at least one image forming apparatus for the output information, and controls the billing unit to calculate the billing charge by using the output information and the billing profile, the billing profile including a plurality of cumulative output amount quotas and quota unit prices corresponding to the plurality of cumulative output amount quotas.

The cumulative output amount may include one of a sum of a cumulative output amount for a previous billing period and an output amount for a target billing period, and the cumulative output amount for the previous billing period, the previous billing period preceding the target billing period.

The billing profile may include at least one of a customer name, a model name of an image forming apparatus, a type of billing jobs, recording medium information, an output information request interval and a billing period.

The output information may include at least one of a device ID, a model name, and counter information.

The management apparatus may further include a display unit which displays thereon a UI screen to set the billing profile and displays the calculated billing charge.

The controller may control the storage unit to store the cumulative output amount therein, and control the billing unit to calculate a billing charge for a next billing period by using the stored cumulative output amount and an output amount for the next billing period calculated from the received output information.

The controller may provide the calculated billing charge to an external device through the communication interface.

The foregoing and/or other aspects may be achieved by providing a billing server which calculates a billing charge of at least one image forming apparatus, the billing server including: a communication interface which receives output information of the at least one image forming apparatus from the at least one image forming apparatus or a management apparatus connected to the at least one image forming apparatus; a storage unit which stores therein a billing profile and the output information; a billing unit which calculates a cumulative output amount by using the output information, and a billing charge for a target billing period corresponding to the at least one image forming apparatus by using the cumulative output amount and the billing profile; and a controller which controls the billing unit to calculate a billing charge by using the output information and the billing profile, and transmits the calculated billing charge to the management apparatus through the communication interface, the billing profile including a plurality of cumulative output amount quotas and a quota unit price corresponding to the plurality of cumulative output amount quotas.

BRIEF DESCRIPTION OF THE DRAWINGS

The above and/or other aspects will become apparent and more readily appreciated from the following description of the exemplary embodiments, taken in conjunction with the accompanying drawings, in which:

FIG. 5 illustrates an example of a user interface screen which is used to set a billing profile for each of a plurality of image forming apparatuses;

FIG. 6A illustrates an example of a brief billing profile for calculating a billing charge according to the exemplary embodiment; and FIG. 6B illustrates an example of calculating a billing charge for a target billing period according to the exemplary embodiment.

DETAILED DESCRIPTION

Figure 1:
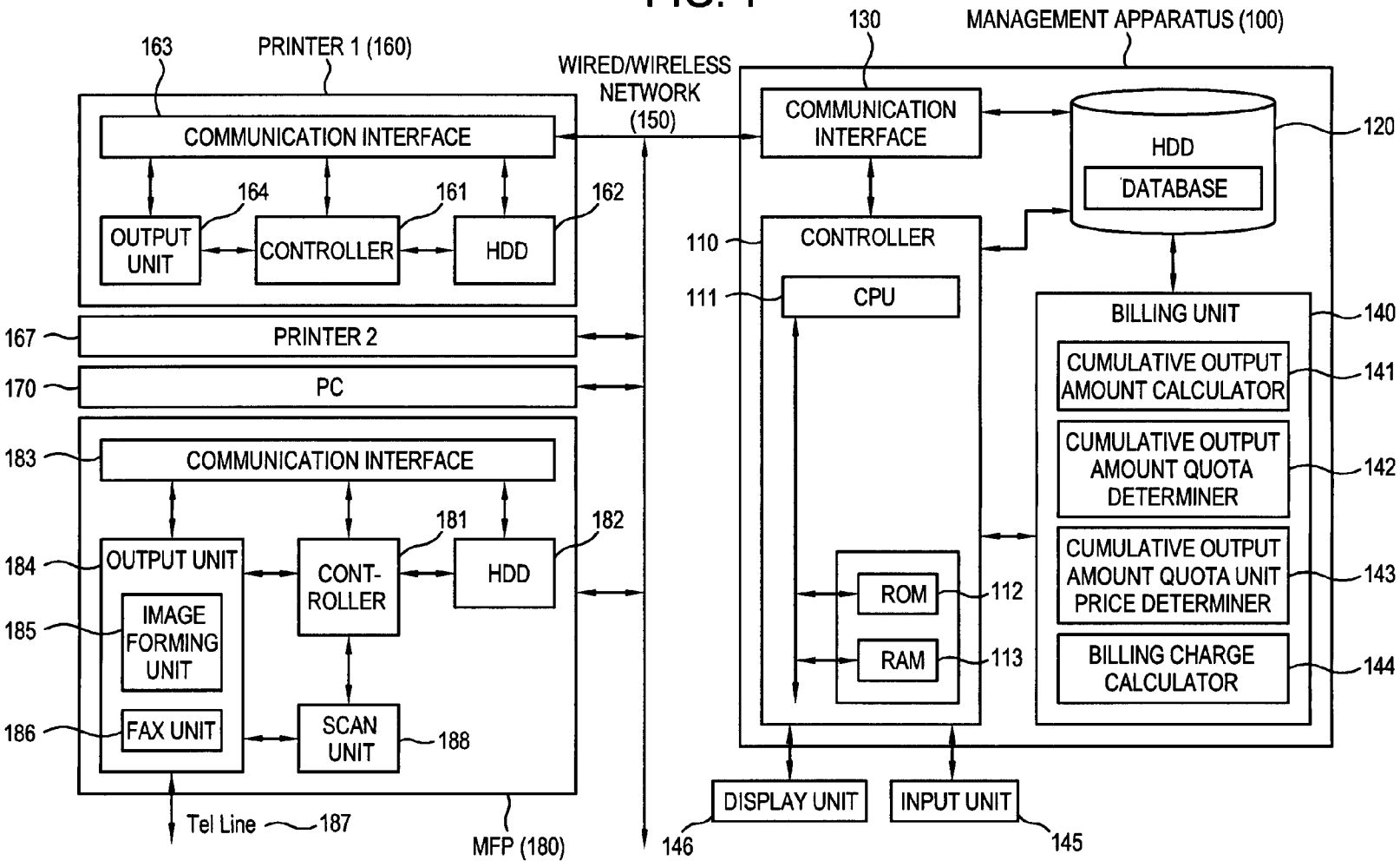
FIG. 1 is a block diagram of an image forming apparatus and a management apparatus according to an exemplary embodiment.

Below, exemplary embodiments will be described in detail with reference to accompanying drawings so as to be easily realized by a person having ordinary knowledge in the art. The exemplary embodiments may be embodied in various forms without being limited to the exemplary embodiments set forth herein. Descriptions of well-known parts are omitted for clarity, and like reference numerals refer to like elements throughout.

FIG. 1 is a block diagram of an image forming apparatus and a management apparatus according to an exemplary embodiment.

Referring to FIG. 1, a management apparatus 100 according to the exemplary embodiment is connected to a wired/wireless network 150, and may also be connected to a universal serial bus (USB) interface (not shown). The management apparatus 100 may be connected to at least one image forming apparatus including a printer 1 160, a printer 2 167 or a multi-function peripheral (MFP) 180, and a personal computer (PC) 170 through the wired/wireless network 150 and the USB interface.

The management apparatus 100 which is connected to the image forming apparatus 160, 167 or 180 subject to billing includes a management server. The management apparatus 100 has a managed printer service (MPS) solution installed therein.

The PC in which the MPS solution may be installed may be included in the management apparatus 100.

The MPS is a solution which calculates a cumulative output amount and a billing charge by using output information including an output amount of at least one image forming apparatus.

The management apparatus 100 includes a controller 110, a hard disk drive (HDD) 120, a communication interface 130, and a billing unit 140. The management apparatus 100 may be connected to a display unit 146 and an input unit 145.

The controller 110 may include a central processing unit (CPU) 111, a read only memory (ROM) 112 storing a control program therein, a random access memory (RAM) 113 storing input data or other relevant operation data therein. The CPU 111, the ROM 112 and the RAM 113 may be connected to one another through an internal bus. The controller 110 controls the HDD 120, the communication interface 130, the billing unit 140, the input unit 145 and the display unit 146.

A user's input for a manipulation of the management apparatus 100 is received through the input unit 145. The input unit 145 may include, e.g., a keyboard (not shown), a mouse (not shown), a touch screen (not shown) or a digitizer (not shown) and other various hardware or software modules.

The display unit 146 is connected to the management apparatus 100 and displays thereon functions of the management apparatus 100. For example, the display unit 146 displays thereon output information and status information corresponding to at least one image forming apparatus, a user interface (UI) screen used to input a billing profile, a set billing profile and a calculated billing charge, status information of the management apparatus 100 and a user's input received through the input unit 145.

The display unit 146 may include at least one of a cathode ray tube (CRT) monitor and a thin film transistor-liquid crystal display (TFT-LCD) panel which displays the foregoing, and a touch screen which not only displays the foregoing but also receives a user's input.

The display unit 146 may include an all-in-one system which is not separated from the management apparatus 100.

The HDD 120 stores therein output information which is received from at least one of the image forming apparatuses 160, 167, and 180. The HDD 120 stores therein a billing profile which is set corresponding to at least one of the image forming apparatuses 160, 167 and 180 by using the input unit 145 and the display unit 146.

At least one of the stored output information and the billing profile may be stored and managed as a database.

The billing profile includes at least two of a customer name, a model name of the image forming apparatus, a device name, a device ID, an IP address, a type of billing jobs, recording medium information, an output information request interval, a billing period, a cumulative output amount quota (hereinafter to be also called "quota") for color/mono print, a cumulative output amount quota unit price (hereinafter, to be also called "quota unit price"), and a basic charge.

The management apparatus 100 requests at least one of the image forming apparatuses 160, 167 and 180 for output information at a preset output information request interval, which may be set in at least one of units of second, minute, hour, day, week, month and year.

The billing period is a period for which the billing charge is calculated, and may be set in at least one of units of at least one of day, week, month and year.

The IP address may be input directly on a UI screen of the billing profile or set in advance.

Hereinafter, the HDD 120, or the ROM 112 or the RAM 113 of the controller 110 will be defined as a storage unit.

The communication interface 130 may be connected to at least one of image forming apparatuses 160, 167 and 180 or at least one PC 170 through the wired/wireless network 150.

The PC 170 may be connected to the management apparatus 100 through the communication interface 130 by using the wired/wireless network 150. The PC 170 may request a billing profile stored in the HDD 120 of the management apparatus 100 or a calculated billing charge by using a web browser of the PC 170 or other various applications, and may receive the billing profile or the billing charge from the management apparatus 100.

The billing unit 140 includes a cumulative output amount calculator 141, a cumulative output amount quota determiner (hereinafter, to be also called "quota determiner") 142, a cumulative output amount quota unit price determiner (hereinafter, to be also called "quota unit price determiner") 143 and a billing charge calculator 144.

Output information which is received from the at least one of the image forming apparatuses 160, 167 and 180 is stored in a database of the HDD 120, and an output amount of the image forming apparatus corresponding to a reception time is stored as log information in the database.

The received output information may include various items to calculate a billing charge, e.g., at least one of a model name of the image forming apparatus, a device name, a device ID, toner information, input tray information, alert information and output counter information.

Depending on items required for the calculation of the billing charge of the management apparatus 100 or its performance, the output information may be requested in whole or in part, and the requested items of the output information may change. The setting or change of the items included in the output information may be performed through an operation panel of the image forming apparatuses 160, 167 or 180 or a UI screen (not shown) displayed on the display unit 146 of the management apparatus 100.

The output counter information includes at least one of a type of billing jobs including print, copy, scan, fax, and e-mail sending jobs, a type of a recording medium, a count unit, duplex/simplex, color/mono, and at least one count.

The output amount means a count, which increases when the image forming apparatus outputs a recording medium, sends a fax, scans or copies a document or sends e-mail.

The count may be collectively stored regardless of the type of billing jobs, or may be stored separately for each job.

That is, an image forming apparatus which only supports a print job stores therein a print count corresponding to the print job. A multi-function peripheral (MFP), which supports print and fax jobs, stores therein a collective count without identifying a print or fax job, or stores therein a count corresponding to the type of billing jobs. For example, the MFP stores therein a print count and a fax count, respectively.

By using the stored output information, the cumulative output amount calculator 141 of the billing unit 140 calculates a cumulative output amount for a target billing period by using a cumulative output amount of a previous billing period and an output amount of the target billing period, the previous billing period preceding the target billing period. The cumulative output amount for the previous billing period may be calculated by using output information received newly from the image forming apparatus 160, 167 or 180 or by using the cumulative output amount for the previous billing period loaded from the database.

The standard for calculating the cumulative output amount may be changed by an agreement entered into between a manufacturer and a customer, and generally includes a billing start time. The billing start time may be changed by a setting of a billing profile. Accordingly, the billing start time is counted, e.g., after 12:00 a.m., 12:00 a.m. of every first day of the month, or 12:00 a.m. on January 1 of every year.

The quota determiner 142 determines at least one quota including a cumulative output amount for the target billing period by using a calculated cumulative output amount for the target billing period and a preset billing profile.

The quota unit price determiner 143 determines a quota unit price if at least one quota including the cumulative output amount for the target billing period is determined by the quota determiner 142. The quota unit price is calculated by using the preset billing profile.

The unit price of the output amount for the target billing period depends upon whether the cumulative output amount for the target billing period belongs to which quota. To that end, it should be determined whether the cumulative output amount for the target billing period belongs to which quota. One, or two or more unit price(s) may apply to the output amount for the target billing period depending upon whether the cumulative output amount for the target billing period belongs to which quota.

For example, if a cumulative output amount for a target billing period is relatively small like the case when a period from a billing start time at which a billing agreement with a customer is started to an expiry of the target billing period is short, a single unit price may apply to the output amount for the target billing period. Meanwhile, if a cumulative output amount for the target billing period is relatively large like the case when a period from a billing start time to an expiry of the target billing period is long, two or more unit prices may apply to the output amount for the target billing period.

If the cumulative output amount for the target billing period, at least one quota and at least one quota unit price are determined, the billing charge calculator 144 calculates a billing charge.

The controller 110 controls operations of the HDD 120, the communication interface 130 and the billing unit 140.

The controller 110 requests at least one of the image forming apparatuses 160, 167 and 180 for output information through the communication interface 130 according to the set billing profile, and the received output information is stored in the database of the HDD 120 by the controller 110.

The controller 110 controls the billing unit 140 to calculate the billing charge by using the stored output information, and controls the display unit 146 to display thereon the calculated billing charge. The display unit 146 may display thereon a report including at least one of a billing charge for the target billing period and a billing charge for a previous billing period.

The report may be printed by at least one of the image forming apparatuses 160, 167 and 180, transmitted by e-mail to at least one PC or transmitted to a remote facsimile.

The calculated cumulative output amount and the billing charge for the target billing period may be stored in the database of the HDD 120 by a control of the controller 110, and the stored cumulative output amount for the target billing period may be used for calculating a cumulative output amount for a next billing period. That is, the cumulative output amount for the target billing period is used as a cumulative output amount for a previous billing period in calculating a cumulative output amount for a next billing period.

The printer 1 160 includes a controller 161, an HDD 162, a communication interface 163 and an output unit 164.

The communication interface 163 is connected to the management apparatus 100 through the wired/wireless network 150. The management apparatus 100 requests the printer 1 160 for output information through the communication interface 163, and the requested output information is transmitted by a control of the controller 161.

The HDD 162 stores therein output information corresponding to an output of the output unit 164. That is, if the output unit 164 performs an output operation, the output information including a print count stored in the HDD 162 is updated.

The HDD 162, or a ROM (not shown) or a RAM (not shown) of the controller 161 is defined as a storage unit.

The output unit 164 outputs print data received from at least one PC 170 or the management apparatus 100. The received print data is controlled by the controller 161 to be output from the output unit 164, or selectively output from the output unit 164 after being processed by an image processor (not shown).

The output unit 164 includes a laser beam printer (LBP), an inkjet printer or a thermal transfer printer according to a type of a print. The output unit 164 according to the present exemplary embodiment includes a laser beam printer as an example.

The MFP 180 may perform not only a print function but also scan and copy functions, and may send fax or e-mail depending upon its performance.

The MFP 180 includes a controller 181, an HDD 182, a communication interface 183, an output unit 184 including an image forming unit 185 and a fax unit 186, and a scan unit 188.

The communication interface 183 is connected to the management apparatus 100 through the wired/wireless network 150. The management apparatus 100 requests the MFP 180 for output information through the communication interface 183, through which the requested output information is transmitted.

The HDD 182 stores therein output information corresponding to an output of the output unit 184 including the image forming unit 185 or the fax unit 186. That is, if the output unit 184 performs an output operation, the output information stored in the HDD 182 corresponding to the image forming unit 185 or the fax unit 186 is updated. That is, a print count or a fax count is updated.

The HDD 182, or a ROM (not shown) or a RAM (not shown) of the controller 181 is defined as a storage unit. The storage unit according to the present exemplary embodiment includes the HDD 182 as an example.

The output unit 184 which includes the image forming unit 185 or the fax unit 186 outputs print data received from at least one PC 170 or the management apparatus 100, or transmits fax data, which is scanned by the scan unit 188, to another facsimile (not shown) through a telephone line 187 by a control of the controller 181.

Document data which is scanned by the scan unit 188 may be copied by the image forming unit 185. The received print data is controlled by the controller 181 to be output by the image forming unit 185, or selectively output by the output unit 185 after being processed by an image processor (not shown).

Depending on a performance of the MFP 180, e-mail may be sent together with scan data scanned by the scan unit 188 as an attachment.

The PC 170 may be connected to the management apparatus 100 through the communication interface 130 by using the wired/wireless network 150. Then, the PC 170 may request the billing profile stored in the HDD 120 or the calculated billing charge through the communication interface 130 of the management apparatus 100 by using the web browser of the PC 170 or applications, and receive the billing profile or the billing charge from the management apparatus 100 by a control of the controller 110.

Figures 2, 2A:
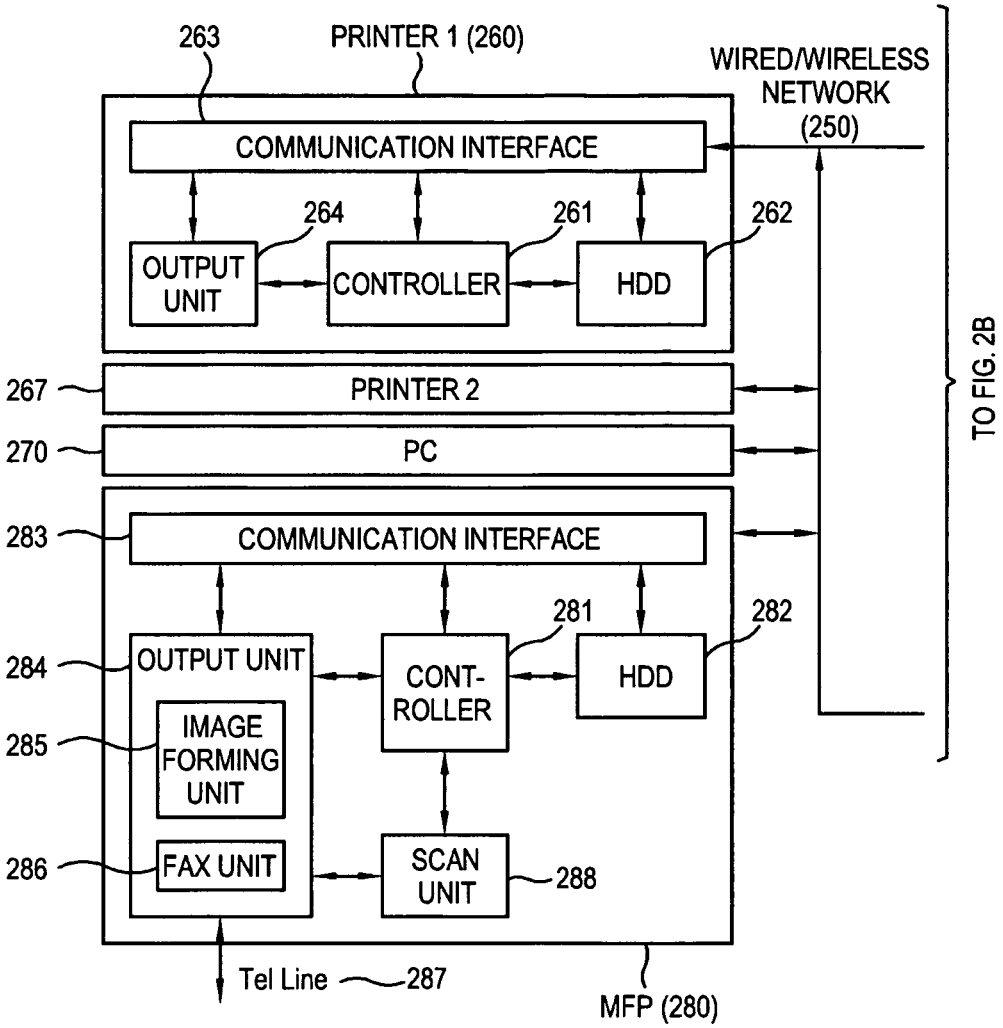
FIGS. 2, 2A and 2B are a block diagram of an image forming apparatus, a management server and a management apparatus according to another exemplary embodiment.
Figure 2B:
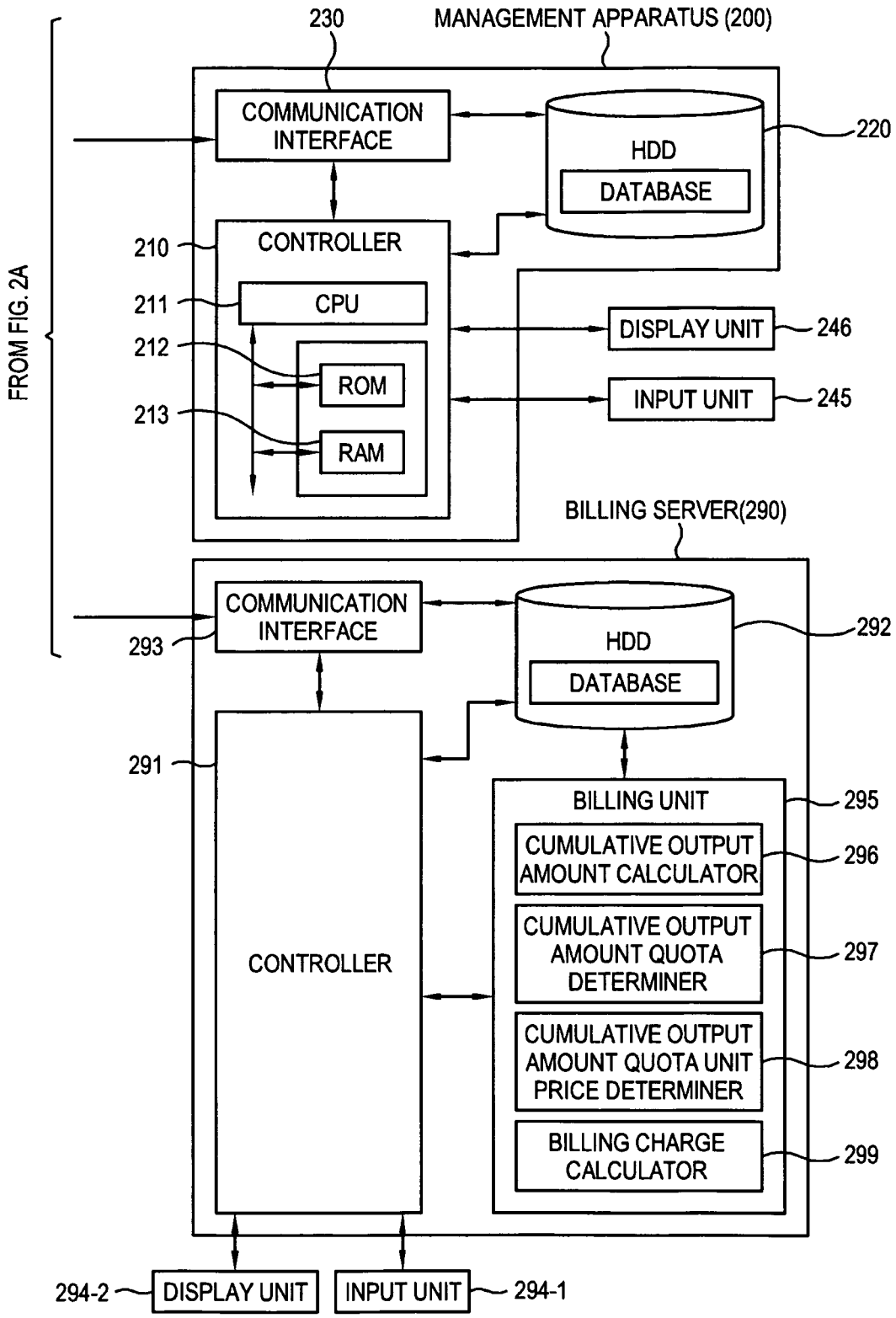

FIGS. 2, 2A and 2B are a block diagram of an image forming apparatus, a management server and a management apparatus according to another exemplary embodiment.

Descriptions which are made with reference to FIG. 1 may apply to configurations in FIGS. 2, 2A and 2B.

Referring to FIGS. 2, 2A and 2B, a management apparatus 200 may be connected to a wired/wireless network 250 and a USB (not shown) interface. The management apparatus 200 may be connected at least one image forming apparatus including a printer 1 260, a printer 2 267 and a MFP 280 and a PC 270 or a billing server 290 through the wired/wireless network 250 and the USB interface.

The management apparatus 200, at least one of the image forming apparatuses 260, 267 and 280 and the billing server 290 may notify status information through the wired/wireless network 250 to one another. The management apparatus 200, at least one of the image forming apparatuses 260, 267 and 280 and the billing server 290 may operate corresponding to the notified status information.

The management apparatus 200 which is connected to the image forming apparatus 260, 267 or 280 which is subject to billing includes a management server. The management apparatus 200 has a MPS solution installed therein.

The management apparatus 200 includes a controller 210, an HDD 220, and a communication interface 230, and may be connected to an input unit 245 and a display unit 246.

The controller 210 may include a CPU 211, a ROM 212 storing a control program therein, and a RAM 213 storing input data or relevant operation data therein. The CPU 211, the ROM 212 and the RAM 213 may be connected to one another through an internal bus. The controller 210 controls the HDD 220, the communication interface 230, the input unit 245 and the display unit 246.

Depending upon a performance of the management apparatus 200, the controller 210 may, in conjunction with a controller 291 of the billing server 290, control the billing server 290. A user's input for a manipulation of the billing server 290 is received through the input unit 294-1. The input unit 294-1 may include, e.g., a keyboard (not shown), a mouse (not shown), a touch screen (not shown) or a digitizer (not shown) and other various hardware or software modules.

As the controller 210 of the management apparatus 200 may be connected to the controller 291 of the billing server 290 through the wired/wireless network 250, the controller 291 of the billing server 290 may execute a HDD 292 and a billing unit 295 of the billing server 290 and transmit a result of the execution to the management apparatus 200 in response to a request of the controller 210 of the management apparatus 200.

A user's input for a manipulation of the management apparatus 200 is received through the input unit 245.

The display unit 246 is connected to the management apparatus 200, and displays thereon a function of the management apparatus 200, e.g., output information corresponding to at least one image forming apparatus, a UI screen for an input of a billing profile, a setting of a billing profile through the input unit 245, a calculated billing charge, a status of the management apparatus 200 and a user's input received through the input unit 245.

The display unit 246 includes at least one of a CRT monitor and a TFT-LCD monitor which have only a display function, and a touch screen which has display and input functions. The display unit 246 and the management apparatus 200 may be configured with an all-in-one system.

The HDD 220 stores therein output information received from at least one of the image forming apparatuses 260, 267 and 280 by a control of the controller 210. Such output information may also be stored in the HDD 292 of the billing server 290.

That is, at least one of the image forming apparatuses 260, 267 and 280 which receives a request for transmitting the output information may transmit the output information to the management apparatus 200 and the billing server 290, respectively.

The HDD 220 stores therein a billing profile corresponding to at least one of the image forming apparatuses 260, 267 and 280 which is set by using the input unit 245 and the display unit 246.

The set billing profile may be stored in the HDD 292 of the billing server 290 by using the wired/wireless network 250 by a control of the controller 220.

Accordingly, the output information and the billing profile stored in the HDD 220 may be used as a backup.

If a billing charge is hard to calculate due to errors of at least one of the output information and the billing profile stored in the billing server 290, at least one of the stored output information and the stored billing profile may be transmitted to the billing server 290 by a control of the controller 210. If necessary, the stored output information and the stored billing profile may be transmitted to another billing server to calculate the billing charge.

According to a control of the controller 291, the received output information and billing profile corresponding to at least one of the image forming apparatuses 260, 267 and 280 are stored in the HDD 292, and the billing charge may be calculated by the billing unit 295.

At least one of the stored output information and the stored billing profile may form a database.

The billing profile includes a customer name, a model name of the image forming apparatus, a device name, a device ID, an IP address, a type of billing jobs, recording medium information, an output information request interval, a billing period, a cumulative output amount quota of color/mono, a quota unit price and a basic charge.

The management apparatus 200 requests at least one of the image forming apparatuses 260, 267 and 280 for output information at a preset output information request interval, which may be set in at least one of units of second, minute, hour, day and week.

The billing period is a period for which a billing charge is calculated, and may be set in at least one of units of day, week, month and year.

The IP address may be directly input from a UI screen of the billing profile or may be set in advance.

The HDD 220, or the ROM 212 or the RAM 213 of the controller 210 is defined as a storage unit, and the HDD 220 according to the present exemplary embodiment is described as the storage unit.

The communication interface 230 may be connected to at least one of the image forming apparatuses 260, 267 and 280, at least one PC 270 or the billing server 290 through the wired/wireless network 250.

The PC 270 may be connected to the management apparatus 200 through the communication interface 230 by using the wired/wireless network 250. The PC 270 may request the billing profile stored in the HDD 220 of the management apparatus 200 or in the HDD 292 of the billing server 290 or a calculated billing charge by using the web browser of the PC 270 or applications, and receive the billing profile and the billing charge from the management apparatus 200.

The billing server 290 includes the controller 291, the HDD 292, the communication interface 293, and the billing unit 295 including a cumulative output amount calculator 296, a cumulative output amount quota determiner (hereinafter, to be also called "quota determiner") 297, a cumulative output amount quota unit price determiner (hereinafter, to be also called "quota unit price determiner") 298 and a billing charge calculator 299.

Output information which is received from at least one of the image forming apparatuses 260, 267 and 280 is stored in a database of the HDD 292 of the billing server 290, and an output amount of the image forming apparatus corresponding to a reception time is stored as log information in the database.

The received output information may include various items for the calculation of the billing charge, e.g., at least one of a model name of the image forming apparatus, a device name, a device ID, toner information, input tray information, alert information and output counter information.

The output information may be requested in whole or in part, such as items necessary for the calculation of the billing charge by the billing unit 295 of the billing server 290, or depending upon performance. The requested items of the output information may be changed. The setting or change of the items included in the output information may be performed through an operation panel of the image forming apparatus 260, 267 or 280, or a UI screen (not shown) displayed on a display unit 294-2 of the billing server 290, or on the display unit 246 of the management apparatus 200.

The output counter information includes at least one of print, copy, scan, fax, e-mail sending jobs subject to billing, a type of a recording medium, a count unit, duplex/simplex, color/mono and at least one count.

An output amount means a count, which increases when the image forming apparatus outputs a recording medium, sends fax, scans or copies a document or sends e-mail.

The count may be collectively stored regardless of the type of the billing jobs, or separately stored by each billing job.

Accordingly, an image forming apparatus which supports only a print job stores therein a print count corresponding to the print job. An MFP which supports print and fax jobs stores therein a collective count without separation of print and fax jobs or a count corresponding to a type of billing jobs. For example, the MFP stores therein a print count and a fax count, respectively.

If a billing charge should be calculated by the controller 291 of the billing server 290, the cumulative output amount calculator 296 of the billing unit 295 calculates a cumulative output amount for a target billing period by using a cumulative output amount for a previous billing period and an output amount for the target billing period, through the stored output information, the previous billing period preceding the target billing period.

The cumulative output amount for the previous billing period may be calculated by using the output information newly received from the image forming apparatus 260, 267 or 280 or by using the cumulative output amount for the previous billing period loaded from the database.

The quota determiner 297 determines at least one quota including the cumulative output amount for a target billing period by using the calculated cumulative output amount for the target billing period and a preset billing profile.

The quota unit price determiner 298 determines a quota unit price if at least one quota including the cumulative output amount for the target billing period is determined by the quota determiner 297. The quota unit price is calculated by using the preset billing profile.

The unit price of the output amount for the target billing period depends upon whether the cumulative output amount for the target billing period belongs to which quota. To that end, it should be determined whether the cumulative output amount for the target billing period belongs to which quota. One, or two or more unit prices may apply to the output amount of the target billing period depending upon whether the cumulative output amount for the target billing period belongs to which quota.

For example, if a cumulative output amount for a target billing period is relatively small like the case when a period from a billing start time at which a billing agreement with a customer starts to an expiry of the target billing period is short, a single unit price may apply to the output amount for the target billing period. Meanwhile, if a cumulative output amount for the target billing period is relatively large like the case when a period from a billing start time to an expiry of the target billing period is long, two or more unit prices may apply to the output amount for the target billing period.

The quota unit price determiner 298 determines a quota unit price if at least one quota including the cumulative output amount for the target billing period is determined by the quota determiner 297. The quota unit price is calculated by using a preset billing profile.

If the cumulative output amount for the target billing period, at least one quota and at least one quota unit price are determined, the billing charge calculator 299 calculates a billing charge.

The controller 291 requests at least one of the image forming apparatuses 260, 267 and 280 for output information through the communication interface 293 according to the set billing profile, and the received output information is stored in the database of the HDD 292.

The controller 291 controls the billing unit 295 to calculate a billing charge by using the stored output information, and controls the display unit 246 or the display unit 294-2 of the management apparatus 200 to display thereon the calculated billing charge. The display unit 246 or the display unit 294-2 may display thereon a report including at least one of the billing charge for the target billing period and a billing charge for a previous billing period.

The report may be printed by at least one of the image forming apparatuses 260, 267 and 280, transmitted by e-mail to at least one PC or transmitted to a remote facsimile.

The calculated cumulative output amount and the billing charge for the target billing period may be stored in the database of the HDD 292 by a control of the controller 210, and the stored cumulative output amount for the target billing period may be used for calculating a cumulative output amount for a next billing period. That is, the cumulative output amount for the target billing period is used as a cumulative output amount for a previous billing period in calculating a cumulative output amount for a next billing period.

The printer 1 260 includes a controller 261, an HDD 262, a communication interface 263 and an output unit 264.

The communication interface 263 is connected to the management apparatus 200 through the wired/wireless network 250. The management apparatus 200 requests the printer 1 260 for output information through the communication interface 263, and the requested output information is transmitted by a control of the controller 261. If necessary, the output information may be transmitted to at least one of the management apparatus 200 and the billing server 290.

The HDD 262 stores therein output information corresponding to an output of the output unit 264. That is, if the output unit 264 performs an output operation, the output information including a print count stored in the HDD 262 is updated.

The HDD 262, or a ROM (not shown) or a RAM (not shown) of the controller 261 is defined as a storage unit.

The output unit 264 outputs print data received from at least one PC 270 or the management apparatus 200. The received print data is controlled by the controller 261 to be output from the output unit 264, or selectively output from the output unit 264 after being processed by an image processor (not shown).

The output unit 264 includes a laser beam printer (LBP), an inkjet printer or a thermal transfer printer according to a type of print. The output unit 264 according to the present exemplary embodiment includes a laser beam printer as an example.

The MFP 280 may perform not only a print function but also scan and copy functions, and may send fax or e-mail or transmit file depending upon its performance.

The MFP 280 includes a controller 281, an HDD 282, a communication interface 283, an output unit 284 including an image forming unit 285 and a fax unit 286, and a scan unit 288.

The communication interface 283 is connected to the management apparatus 200 or the management server 290 through the wired/wireless network 250. The management apparatus 200 or the management server 290 requests the MFP 280 for output information through the communication interface 283, through which the requested output information is transmitted.

The HDD 282 stores therein output information corresponding to an output of the output unit 284 including the image forming unit 285 or the fax unit 286. That is, if the output unit 284 performs an output operation, the output information stored in the HDD 282 corresponding to the image forming unit 285 or the fax unit 286 is updated. That is, a print count or a fax count is updated.

The HDD 282, or a ROM (not shown) or a RAM (not shown) of the controller 281 is defined as a storage unit. The storage unit according to the present exemplary embodiment includes the HDD 282 as an example.

The output unit 284 which includes the image forming unit 285 or the fax unit 286 outputs print data received from at least one PC 270 or the management apparatus 200, or fax data received from a remote facsimile, or transmits fax data, which is scanned by the scan unit 288, to another facsimile (not shown) through a telephone line 287 by a control of the controller 281.

Document data which is scanned by the scan unit 288 may be copied by the image forming unit 285.

The received print data is controlled by the controller 281 to be output by the image forming unit 285, or selectively output by the output unit 285 after being processed by an image processor (not shown).

Depending on a performance of the MFP 280, e-mail may be sent together with scan data scanned by the scan unit 288 as an attachment.

Print, display, e-mail sending and fax sending jobs are defined as an output. Accordingly, the MFP 280 includes a print count, a fax count, an e-mail count and a copy count.

The PC 270 may be connected to the management apparatus 200 through the communication interface 230 by using the wired/wireless network 250. Then, the PC 270 may request the billing profile stored in the HDD 220 or the calculated billing charge through the communication interface 230 of the management apparatus 200 by using the web browser of the PC 270 or applications, and receive the billing profile or the billing charge from the management apparatus 200 by a control of the controller 210.

Figure 3:
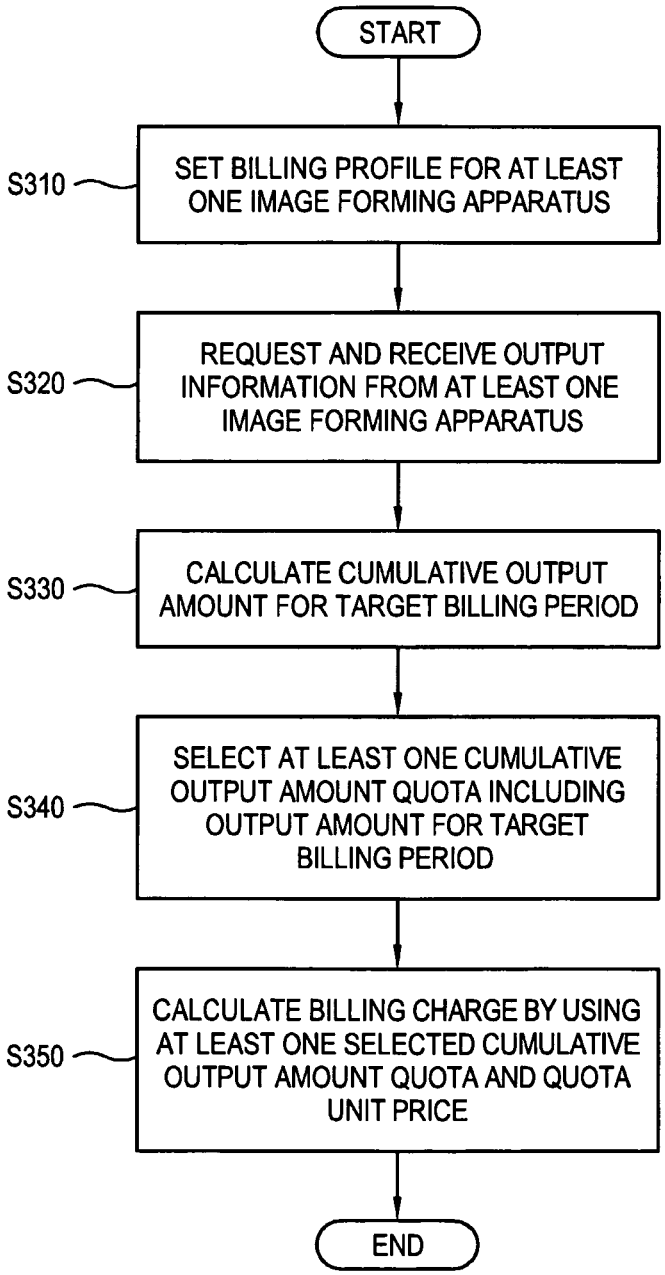
FIG. 3 is a flowchart of a billing method of the management apparatus according to the exemplary embodiment.

FIG. 3 is a flowchart of a billing method of the management apparatus 100 according to the exemplary embodiment.

Referring to FIG. 3, the billing method of the management apparatus 100 including the billing unit 140 will be described only. As shown in FIGS. 2, 2A AND 2B, however, even if the management apparatus 200 and the billing server 290 are realized as separate hardware units or software units, the billing method in FIG. 3 may apply similarly.

Referring to FIG. 3, the billing profile is set corresponding to at least one image forming apparatus by using the display unit 145 and the input unit 146 of the management apparatus 100 (S310).

That is, the set billing profile may include a customer name, a model name of the image forming apparatus, a device name, a device ID, an IP address, a type of billing jobs, recording medium information, an output information request interval, a billing period, a cumulative output amount quota of color/mono print, a quota unit price and a basic charge.

The billing profile may be realized as that in FIG. 5, and the billing method of the management apparatus 100 will be described in detail with reference to FIGS. 3 and 5.

FIG. 5 illustrates an example of a UI screen to set a billing profile for each of the plurality of image forming apparatuses.

Referring to FIG. 5, a billing profile for each of a plurality of image forming apparatuses ML-4000N, SCX-2000FN and CLX-3000N includes a model name item 510, a quota item 520, a +/− (adding/deleting) quota item 530 for an input cumulative output amount quota, a basic charge item 540 and a quota unit price item 550 for a color output, a basic charge item 560 and a quota unit price item 570 for a mono output and a recording medium item 580.

The model name item 510 displays a model name of at least one image forming apparatus connected through the wired/wireless network 150. If there are at least two image forming apparatuses having the same model name, those two or more image forming apparatuses are displayed, and at least one of the two or more image forming apparatuses subject to billing may be selected.

At least one image forming apparatus which has the same model name may have the same billing profile or different billing profiles. That is, if at least one image forming apparatus having the same model name has different billing profiles, the at least one image forming apparatus should be identified individually. Each of the at least one image forming apparatus may be identified by at least one of its device name, device ID and IP address.

The billing profile may be set from a UI screen displayed on the display unit 146, or a preset billing profile may be loaded from the HDD 120. The billing profile may be loaded from the outside of the management apparatus 100 as the case may be.

The billing profile items 510 to 580 which are set according to at least one image forming apparatus subject to billing may be added or deleted. For example, if at least one image forming apparatus which is subject to billing supports a mono output, the basic charge item 540 and the quota unit price item 550 for the color output are not needed. If the image forming apparatus which is subject to billing includes a MFP including a fax function or a facsimile, the billing profile may additionally have a basic charge item (not shown) and a quota unit price (not shown) for a color or mono output corresponding to fax sending and receiving functions.

The billing profile item may be set corresponding to at least one image forming apparatus subject to billing. The billing profile may also be set corresponding to at least one function supported by the at least one image forming apparatus, e.g., print, copy, scan, fax, e-mail sending or file sending jobs.

FIG. 5 illustrates an example of a billing profile for a print job. In the case of an image forming apparatus which performs a fax function, a billing profile for a fax job may be added.

Returning to FIG. 3, the controller 110 requests at least one of the image forming apparatuses 160, 167 and 180 for the output information to calculate the billing charge by using the set billing profile, and receives the requested output information (S320).

The received output information is stored in the HDD 120.

If the billing charge for the target billing period is calculated, the cumulative output amount for the target billing period is calculated by using the billing profile stored in the HDD 120 and the count included in the output information by a control of the controller 110 (S330).

If the target billing period includes a first billing period starting from the billing start time, the cumulative output amount for a previous billing period is zero, the previous billing period precedes the target billing period.

The cumulative output amount for the target billing period is the sum of the cumulative output amount for the previous billing period and the output amount for the target billing period, and the cumulative output amount for the target billing period at operation S330 may be replaced by the cumulative output amount for the previous billing period.

The cumulative output amount may include at least one of a sum of the cumulative output amount for the previous billing period and the output amount for the target billing period, and the cumulative output amount for the previous billing period.

The cumulative output amount for the previous billing period starting from the billing start time may be newly calculated by using the stored output information, or a prestored cumulative output amount may be used.

The quota corresponding to the calculated cumulative output amount for the target billing period is set by using the set billing profile (S340).

There may be one or two or more quotas selected. If there are two or more quotas, the billing charge for the target billing period is calculated by using two or more quota prices corresponding to the two or more quotas (S350).

The calculated billing charge for the target billing period is displayed on the display unit 146 of the management apparatus 100 or displayed as a report including the billing charge for at least one previous billing period and the billing charge for the target billing period.

The report may be output by at least one image forming apparatus, or transmitted by e-mail or fax.

The billing charge and the cumulative output amount for the target billing period may be stored in the database of the HDD 120. Otherwise, the billing charge and the cumulative output amount may be stored as a report. The stored report may be loaded and displayed on the display unit 146 or printed by the image forming unit 185.

In the case of the MFP 180, the billing charge and the cumulative output amount may be transmitted by the fax unit 186 or transmitted as e-mail by an e-mail sender (not shown).

The copy, print, scan, fax sending/receiving, e-mail sending/receiving and file transmitting jobs are defined as an output.

The detailed billing method corresponding to operation S340 and S350 will be described with reference to FIG. 4.

Figure 4:
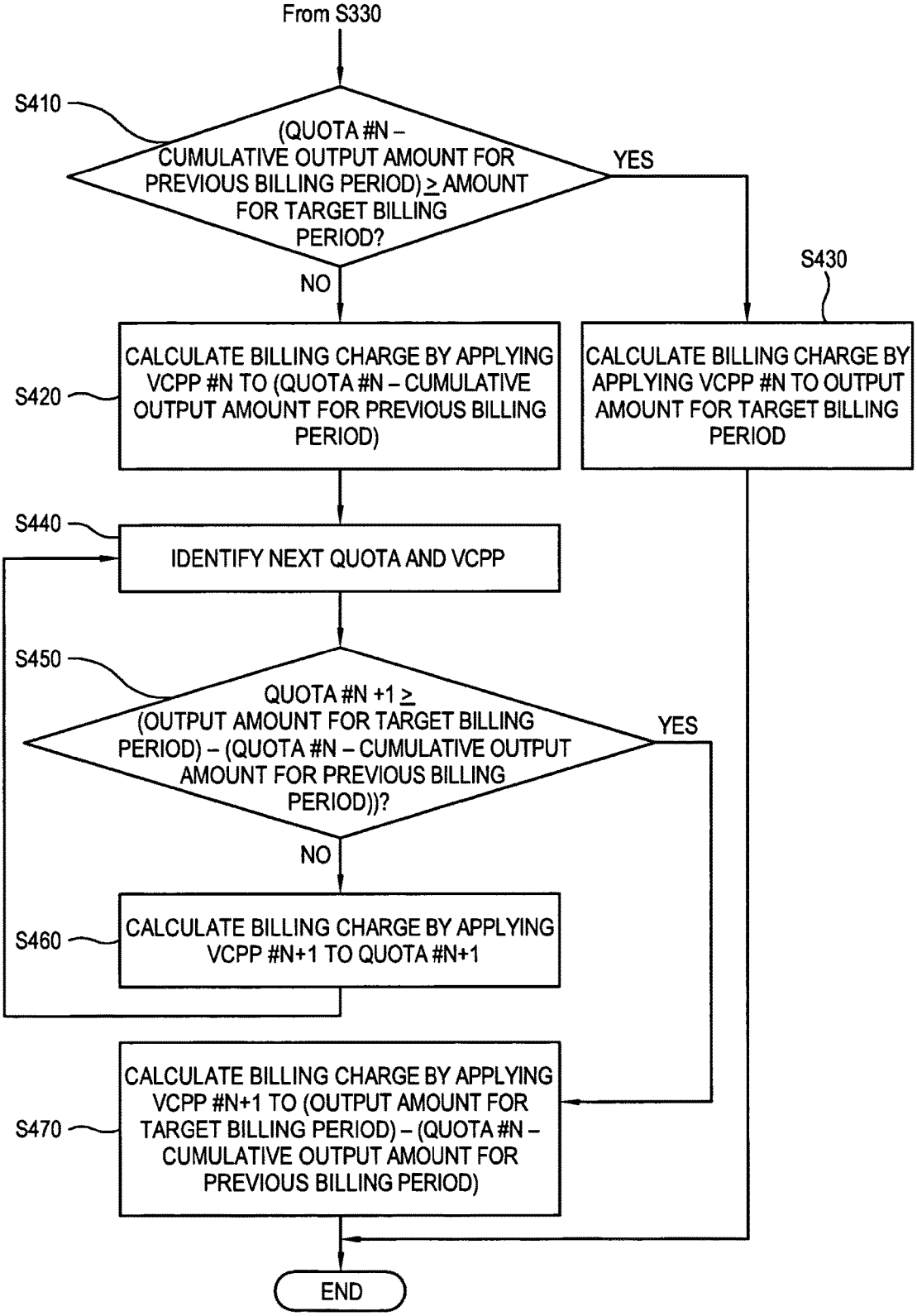
FIG. 4 is a detailed flowchart of operations S340 to S350 in FIG. 3 according to the exemplary embodiment.

FIG. 4 is a detailed flowchart of operations S340 and S350 in FIG. 3.

FIG. 6A illustrates an example of a brief billing profile corresponding to the image forming apparatus named ML-4000N.

Referring to FIG. 6A, the billing profile corresponding to the image forming apparatus named ML-4000N defines each range of a plurality of quotas, quota unit prices, a basic charge, an output color and a recording medium.

In the billing profile in FIG. 6A, the model name is ML-4000N, a quota #1 ranges from 0 to 2000, a quota #2 ranges from 2001 to 5000, a quota #3 ranges from 5001 to 10000, an output color is mono and a recording medium is A4.

A quota unit price #1 is USD 0.05, a quota unit price #2 is USD 0.03, a quota unit price #3 is USD 0.02 and a basic charge is USD 150.

FIG. 6B illustrates a calculation of a billing charge for billing periods #1 to #3 of the image forming apparatus named ML-4000N.

Referring to FIG. 6B, an output amount for a billing period #1 is 500, an output amount for a billing period #2 is 1200 and an output amount for a billing period #3 is 3000.

The target billing period to be calculated is the billing period #3, and the billing periods #1 and #2 are assumed to be previous billing periods preceding the target billing period. The billing period may be set in the unit of one month, two months, a quarter, a half year or one year, and may be changed by an agreement with the customer.

The process for calculating the cumulative output amount and the billing charge for the billing periods #1 and #2 as the previous billing periods, and the process for calculating the cumulative output amount and the billing charge for the billing period #3 as the target billing period will be described.

Referring to FIG. 4, the cumulative output amount for the target billing period calculated at operation S330 is used to determine whether "Quota #1–cumulative output amount for the previous billing period>(output amount for target billing period)" is satisfied (S410).

The output amount for the billing period #1 is 500. The cumulative output amount quota #1, i.e., the Quota #1 ranges from zero to 2000. The cumulative output amount for the previous billing period in the billing period #1 is zero. Accordingly, $\{(2000-0)\geq 500\}$ and the billing charge for the billing period #1 is calculated. That is, the cumulative output amount for the billing period #1 is 500, which belongs to the Quota #1 applying to the billing period #1. The quota unit price #1, i.e., a variable cost per page (VCPP) #1 of USD 0.05 applies to the billing period #1, and the variable cost is calculated.

Accordingly, the billing charge for the billing period #1 is USD 175, which is the sum of a basic charge of USD 150 and a variable cost of USD 25 (S430).

The output amount for the billing period #2 is 1200. The Quota #1 ranges from zero to 2000. On the basis of the billing period #2, the cumulative output amount for the previous billing period (billing period #1) is 500. Accordingly, an inequality of $\{(2000-500)\geq 1200\}$ is established (S410), and the variable cost is USD 60 by applying the VCCP #1 (USD 0.05) to the output amount for the billing period #2 of 1200.

Thus, the billing charge for the billing period #2 is USD 210, which is the sum of the basic charge of USD 150 and the variable cost of USD 60 (S430).

As the output amount for the billing period #1 and the billing period #2 belongs to the Quota #1, a single quota and a single quota unit price are used to calculate the billing charge.

As the output amount for the billing period #3 is 3000 and the cumulative output amount for the previous billing period is 1700, the cumulative output amount for the billing period #3 is 4700.

As the cumulative output amount for the billing period #3 of 4700 exceeds the Quota #1 ranging from zero to 2000, and belongs to the Quota #2 ranging from 2001 to 5000, the Quota #1 and the VCPP #1 apply to some of the output amount of 3000 and the Quota #2 and the VCPP #2 apply to the other of the output amount of 3000 in calculating the billing charge for the billing period #3.

More specifically, the cumulative output amount for (billing period #1+billing period #2) is 1700. Thus, the inequality of {(2000−1700)≥3000} is not established.

As for the output amount for the billing period #3 of 3000, the VCPP #1 (USD 0.05) applies to the remainder of the Quota #1 of 300, and the variable cost is USD 15 (S420).

As for the remainder of the output amount for the billing period #3, i.e., 2700, the next Quota #2 and VCPP #2 are identified (S440).

The Quota #2 ranges from 2001 to 5000 and the cumulative output amount quota unit price #2 (VCPP #2) is USD 0.03, which are identified with reference to the billing profile.

In the case of the remainder of the output amount for the billing period #3, i.e., 2700, the equality of {3000≥(3000−(2000−1700))} is satisfied (S450), and the variable costs is USD 81 by applying the VCPP #2 (USD 0.03).

Accordingly, the billing charge for the billing period #3 is USD 246, which is the sum of the basic charge of USD 150 and the variable cost of (USD 15+USD 81) (S470).

If a billing charge for a billing period #4 (not shown) should be calculated, as the remainder of the Quota #2 is 300, the VCPP #2 (USD 0.03) applies to the remainder of the Quota #2 of 300 and the billing charge for some of the output amount of the billing period #4, that is 300 is calculated if the output amount for the billing period #4 exceeds 300 (S460).

As for the remainder of the output amount for the billing period #4, next Quota #3 and VCPP #3 are identified. The Quota #3 ranges from 5001 to 10000, and the VCPP #3 is USD 0.02, which are identified with reference to the billing profile.

As for the remainder of the output amount for the billing period #4, the billing charge is calculated according to whether the inequality at operation S450 is satisfied.

As described in FIG. 6B, the billing charge may be calculated by at least one of the billing unit 140 of the management apparatus 100 and the billing unit 295 of the billing server 290, and may be displayed on the display unit 146 of the management apparatus 100 or the display unit 294-2 of the billing server 290.

The items in FIG. 6B may be used as a report. If the PC 170 connected through the wired/wireless network 150 requests for such items (particularly, the billing charge), the controller 110 provides the calculated billing charge.

The embodiments, can be implemented in computing hardware (computing apparatus) and/or software, such as (in a non-limiting example) any computer that can store, retrieve, process and/or output data and/or communicate with other computers. The results produced can be displayed on a display of the computing hardware. A program/software implementing the embodiments may be recorded on computer-readable media comprising computer-readable recording media. Examples of the computer-readable recording media include a magnetic recording apparatus, an optical disk, a magneto-optical disk, and/or a semiconductor memory (for example, RAM, ROM, etc.). Examples of the magnetic recording apparatus include a hard disk device (HDD), a flexible disk (FD), and a magnetic tape (MT). Examples of the optical disk include a DVD (Digital Versatile Disc), a DVD-RAM, a CD-ROM (Compact Disc-Read Only Memory), and a CD-R (Recordable)/RW.

As described above, a management apparatus and a billing method thereof according to the exemplary embodiments calculates a billing charge for at least one image forming apparatus by using a cumulative output amount for a billing period.

Although a few exemplary embodiments have been shown and described, it will be appreciated by those skilled in the art that changes may be made in these exemplary embodiments without departing from the principles and spirit of the invention, the scope of which is defined in the appended claims and their equivalents.

What is claimed is:

1. A method of managing at least one image forming apparatus, the method comprising:

setting, at a management apparatus remotely connected to the at least one image forming apparatus, a billing profile corresponding to the at least one image forming apparatus through a user interface (UI) screen provided by a display unit of the management apparatus;

setting, using the UI screen, a duration of a target billing period, an output information request interval, a plurality of cumulative output amount quotas, and quota unit prices corresponding to the plurality of cumulative output amount quotas, in the billing profile corresponding to the at least one image forming apparatus;

requesting, using a communication interface of the management apparatus and based on the output information request interval set in the billing profile, output information relating to the billing profile and tracked by the at least one image forming apparatus;

receiving, using the communication interface of the management apparatus, the output information from the at least one image forming apparatus;

storing, in at least one database, the billing profile set using the UI screen and the output information received from the at least one image forming apparatus:

determining, by at least one specially programmed processor including a billing unit, an output amount of the at least one image forming apparatus for the target billing period, based on the output information received from the at least one image forming apparatus and stored in the at least one database:

calculating, by a cumulative output amount calculator of the billing unit, a cumulative output amount for the target billing period by summing the output amount for the target billing period stored in the at least one database with a cumulative output amount for a previous billing period stored in the at least one database, the previous billing period preceding the target billing period;

calculating, by a billing charge calculator of the billing unit and by using the billing profile stored in the at least one database, a billing charge for the target billing period corresponding to the at least one image forming apparatus by using the output amount for the target billing period and a selected unit price from among the quota unit prices which is selected by a quota unit price determiner of the billing unit based on the calculated cumulative output amount for the target billing period;

displaying the calculated billing charge on the display unit of the management apparatus;

storing the billing charge and the cumulative output amount for the target billing period in the at least one database, the cumulative output amount for the target billing period stored in the at least one database to be used for calculating a next cumulative output amount for a next target billing period; and in response to an error occurring in the calculating of at least one of the cumulative output amount for the target billing period and the billing charge by the billing unit, provided in a server remotely disposed from the management apparatus, transmitting, by the management apparatus, at least one of the output information and the billing profile to the server so that the billing unit provided in the server correctly calculates the at least one of the cumulative output amount for the target billing period and the billing charge; and transmitting data corresponding to the billing charge to the image forming apparatus to allow the image forming apparatus to perform an image forming job with respect to the data.

2. The method according to claim 1, wherein the billing profile comprises at least one of a customer name, a model name of an image forming apparatus, a type of billing jobs, and recording medium information7-an output information request interval and a billing period.

3. The method according to claim 1, wherein the output information comprises at least one of a device ID, a model name, and counter information.

4. The method according to claim 1, wherein the calculating the billing charge for the target billing period comprises calculating the billing charge for the target billing period by applying a same quota unit price to the entire output amount for the target billing period or applying a plurality of different quota unit prices to the output amount for the target billing period.

5. The method according to claim 1, wherein the billing charge further comprises a basic charge.

6. The method according to claim 1, further comprising providing the billing charge to an external device through a communication interface of the management apparatus.

7. The method according to claim 1, wherein different image forming apparatuses with the same model name comprise different billing profiles.

8. The method according to claim 1, further comprising initializing information on an output amount for at least one billing period.

9. The method according to claim 1, wherein the billing profile is changeable with respect to at least one image forming apparatus.

10. The method according to claim 1, further comprising:

calculating a billing charge for the next target billing period by using the stored cumulative output amount for the target billing period stored in the at least one database and an output amount for the next target billing period.

11. A management apparatus, comprising:

a communication interface which is remotely connected to at least one image forming apparatus, and receives output information from the at least one image forming apparatus;

a display unit which displays thereon a user interface (UI) screen to set a billing profile corresponding to the at least one image forming apparatus, the UI screen configured to receive an input of a duration of a target billing period, a plurality of cumulative output amount quotas, an output information request interval, and quota unit prices corresponding to the plurality of cumulative output amount quotas, in the billing profile corresponding to the at least one image forming apparatus;

a storage unit which stores therein the billing profile and the output information corresponding to the at least one image forming apparatus in at least one database of the storage unit;

at least one specially programmed processor including:

a cumulative output amount calculator which calculates a cumulative output amount by using the output information stored in the at least one database;

a quota unit price determiner which selects a unit price from among the quota unit prices based on the calculated cumulative output amount for the target billing period and by using the billing profile stored in the at least one database, and a billing charge calculator which calculates a billing charge for the target billing period corresponding to the at least one image forming apparatus by using the output amount for the target billing period and the selected unit price from among the quota unit prices which is selected based on the calculated cumulative output amount for the target billing period; and a controller which requests the at least one image forming apparatus to provide the output information according to the output information request interval set in the billing profile, and controls the at least one specially programmed processor to calculate the billing charge by using the cumulative output amount, the output information and the billing profile corresponding to the at least one image forming apparatus, wherein the cumulative output amount calculator calculates the cumulative output amount by summing an output amount for the target billing period with a cumulative output amount for a previous billing period, the previous billing period preceding the target billing period, the controller controls the display unit to display the calculated billing charge, the controller stores the billing charge and the cumulative output amount for the target billing period in the at least one database, the cumulative output amount for the target billing period stored in the at least one database to be used for calculating a next cumulative output amount for a next target billing period, in response to an error occurring in the calculating of at least one of the cumulative output amount for the target billing period and the billing charge by another billing unit provided in a server remotely disposed from the management apparatus, the controller transmit at least one of the output information and the billing profile to the server so that the another billing unit provided in the server correctly calculates the at least one of the cumulative output amount for the target billing period and the billing charge, and the controller transmits data corresponding to the billing charge to the image forming apparatus to allow the image forming apparatus to perform an image forming job with respect to the data.

12. The management apparatus according to claim 11, wherein the billing profile comprises at least one of a customer name, a model name of an image forming apparatus, a type of billing jobs, and recording medium information.

13. The management apparatus according to claim 11, wherein the output information comprises at least one of a device ID, a model name, and counter information.

14. The management apparatus according to claim 11, wherein the controller controls the billing unit to calculate a billing charge for a-the next target billing period by using the stored cumulative output amount for the target billing period stored in the at least one database and an output amount for the next target billing period calculated from the received output information.

15. The management apparatus according to claim 11, wherein the controller provides the calculated billing charge to an external device through the communication interface.

16. A server, comprising:

a communication interface which receives output information of at least one image forming apparatus from the at least one image forming apparatus or receives output information of the at least one image forming apparatus from a management apparatus connected to the at least one image forming apparatus;

a storage unit which stores the output information and a billing profile set using an input unit of the management apparatus in a database of the storage unit:

at least one specially programmed processor including:

a cumulative output amount calculator which calculates a cumulative output amount by using the output information stored in the at least one database, a quota unit price determiner which selects a unit price from among quota unit prices set in the billing profile stored in the at least one database, and a billing charge calculator which calculates a billing charge for a target billing period corresponding to the at least one image forming apparatus by using the cumulative output amount and the billing profile stored in the at least one database: and a controller which controls the at least one specially programmed processor to calculate the billing charge by using the output information stored in the at least one database and the billing profile stored in the at least one database, and controls the communication interface to transmit the calculated billing charge to the management apparatus, wherein the billing profile comprises a plurality of cumulative output amount quotas and the quota unit prices corresponding to the plurality of cumulative output amount quotas, the cumulative output amount calculator calculates the cumulative output amount by summing an output amount for the target billing period stored in the at least one database with a cumulative output amount for a previous billing period stored in the at least one database, the previous billing period preceding the target billing period, the billing charge calculator calculates the billing charge for the target billing period by using the output amount for the target billing period stored in the at least one database and the selected unit price from among the quota unit prices which is selected based on the calculated cumulative output amount for the target billing period, the server and the management apparatus are remotely connected to the at least one image forming apparatus, the controller controls at least one of a display unit of the server and a display unit of the management apparatus to display the calculated billing charge, the controller stores the billing charge and the cumulative output amount for the target billing period in the at least one database, the cumulative output amount for the target billing period stored in the at least one database to be used for calculating a next cumulative output amount for a next target billing period, in response to an error occurring in the calculating by the server of at least one of the cumulative output amount for the target billing period and the billing charge, the controller transmits a request to the management apparatus for at least one of the output information and the billing profile so that the server receives the at least one of the cumulative output amount for the target billing period and the billing charge from the management apparatus and correctly calculates the at least one of the cumulative output amount for the target billing period and the billing charge, and the controller transmits data corresponding to the billing charge to the image forming apparatus to allow the image forming apparatus to perform an image forming job with respect to the data.

17. The method according to claim 1, wherein the target billing period and previous billing period are set in units of time including at least one of one or more days, one or more weeks, one or more months, one or more years, or any combination thereof.

* * * * *